US009835377B2

(12) United States Patent
Gourdel et al.

(10) Patent No.: US 9,835,377 B2
(45) Date of Patent: Dec. 5, 2017

(54) SUPPORT DEVICE FOR A PLURALITY OF WAFERS FOR A VERTICAL OVEN

(71) Applicant: Soitec, Crolles (FR)

(72) Inventors: Christophe Gourdel, Saint Maximin (FR); Alexandre Barthelemy, Grenoble (FR)

(73) Assignee: Soitec, Bernin (FR)

( * ) Notice: Subject to any disclaimer, the term of this patent is extended or adjusted under 35 U.S.C. 154(b) by 40 days.

(21) Appl. No.: 14/425,549

(22) PCT Filed: Aug. 20, 2013

(86) PCT No.: PCT/IB2013/001824

§ 371 (c)(1),
(2) Date: Mar. 3, 2015

(87) PCT Pub. No.: WO2014/037777

PCT Pub. Date: Mar. 13, 2014

(65) Prior Publication Data

US 2015/0211800 A1 Jul. 30, 2015

(30) Foreign Application Priority Data

Sep. 10, 2012 (FR) ..... 12 02435

(51) Int. Cl.
*F27D 5/00* (2006.01)

(52) U.S. Cl.
CPC ..... *F27D 5/0037* (2013.01)

(58) Field of Classification Search
CPC ..... H01L 21/67309; H01L 21/6875; H01L 21/6732

(Continued)

(56) References Cited

U.S. PATENT DOCUMENTS 4,001,047 A 1/1977 Boah
5,507,873 A * 4/1996 Ishizuka ..... H01L 21/67309 118/500

(Continued)

FOREIGN PATENT DOCUMENTS

CN 1365512 A 8/2002
CN 1371527 9/2002

(Continued)

OTHER PUBLICATIONS

Chinese Office Action and Search Report for Chinese Application No. 201380046873.X dated Jan. 20, 2016, 12 pages.

(Continued)

*Primary Examiner* — Gregory A Wilson
(74) *Attorney, Agent, or Firm* — TraskBritt

(57) ABSTRACT

A support device that has a central axis and includes three uprights extending substantially parallel to the central axis, a plurality of series of support members spaced along the central axis, each series of support members comprising three support members adapted to support one wafer of the plurality of wafers and extending in different essentially longitudinal directions transverse to the central axis, each support member being mounted directly on a separate upright, this support device being remarkable in that the directions of the three support members of each series of support members are concurrent at a point on the central axis.

16 Claims, 4 Drawing Sheets

(58) Field of Classification Search
USPC ..... 432/253, 258, 259; 211/41.18; 206/454; 438/795
See application file for complete search history.

(56) References Cited

U.S. PATENT DOCUMENTS

| | | | | |
|---|---|---|---|---|
| 5,586,880 | A * | 12/1996 | Ohsawa | C30B 25/12 432/241 |
| 6,099,302 | A | 8/2000 | Hong et al. | |
| 6,361,313 | B1 * | 3/2002 | Beyaert | H01L 21/67309 211/41.18 |
| 6,450,346 | B1 * | 9/2002 | Boyle | H01L 21/67303 118/500 |
| 6,488,497 | B1 * | 12/2002 | Buckley | C30B 25/12 211/41.18 |
| 7,033,168 | B1 * | 4/2006 | Gupta | C23C 16/4583 211/41.18 |
| 7,241,141 | B2 * | 7/2007 | Wedel | H01L 21/67309 211/41.18 |
| 7,891,975 | B2 * | 2/2011 | Sasajima | C30B 35/00 211/41.18 |
| 8,469,703 | B2 * | 6/2013 | Kobayashi | H01L 21/67309 118/500 |
| 2007/0082314 | A1 | 4/2007 | Wedel | |

FOREIGN PATENT DOCUMENTS

| | | | |
|---|---|---|---|
| CN | 1371527 | A | 9/2002 |
| CN | 1173384 | C | 10/2004 |
| CN | 1748301 | A | 3/2006 |
| CN | 1768421 | A | 5/2006 |
| WO | 2008095154 | A1 | 8/2008 |

OTHER PUBLICATIONS

International Preliminary Report on Patentability for International Application No. PCT/IB2013/001824 dated Mar. 10, 2015, 5 pages.
International Written Opinion for International Application No. PCT/IB2013/001824 dated Nov. 4, 2013, 4 pages.
International Search Report for International Application No. PCT/IB2013/001824 dated Nov. 4, 2013, 4 pages.
Chinese Office Action and Search Rerport for Chinese Application No. 201380046873.X dated Jul. 20, 2016, 4 pages.
Chinese Third Office Action for Chinese Application No. 201380046873.X dated Jan. 11, 2017, 4 pages.

* cited by examiner

SUPPORT DEVICE FOR A PLURALITY OF WAFERS FOR A VERTICAL OVEN

CROSS-REFERENCE TO RELATED APPLICATIONS

This application is a national phase entry under 35 U.S.C. §371 of International Patent Application PCT/IB2013/001824, filed Aug. 20, 2013, designating the United States of America and published in English as International Patent Publication WO 2014/037777 A1 on Mar. 13, 2014, which claims the benefit under Article 8 of the Patent Cooperation Treaty and under 35 U.S.C. §119(e) to France Patent Application Serial No. 1202435, filed Sep. 10, 2012, the disclosure of each of which is hereby incorporated herein in its entirety by this reference.

TECHNICAL FIELD

The present invention concerns a support device for a plurality of wafers.

BACKGROUND

A known prior art support device for a plurality of wafers, shown in FIGS. 1A and 1B, is a support device for a plurality of wafers, the support device 10 being adapted to be loaded into a heat treatment oven, the support device 10 having a central axis, the support device 10 including:

three uprights 30, 31 and 32 extending substantially parallel to the central axis, a plurality of series of support members 35 spaced along the central axis, each series of support members 35 comprising three support members 40, 41 and 42 adapted to support one wafer W of the plurality of wafers and extending in different essentially longitudinal directions transverse to the central axis, each support member 40, 41 and 42 being mounted directly on a separate upright.

Accordingly, a heat treatment step consists in positioning a support device 10 containing a plurality of wafers W in a vertical heat treatment oven (not shown). Each series of support members 35 of the support device 10 includes three support members 40, 41 and 42, the function of which is to hold a wafer W in a horizontal position. FIG. 1B shows the positioning of a wafer W relative to the support members 40, 41 and 42. The support members are mounted directly on separate uprights 30, 31 and 32 and the disposition of the support members 40, 41 and 42 is adapted to ensure that a wafer W is held in a stable equilibrium position. Inside the vertical heat treatment oven, heating elements are disposed around a quartz tube into which the support device 10 is inserted. The wafers disposed horizontally in the support device 10 are heated radially by the heating elements. However, the support members 41 and 42 block some of the radiant flux during a heat treatment step and a locally heterogeneous temperature field is observed over the volume of the wafer W at the level of the support members 41 and 42, as shown in FIG. 2 (the shaded area symbolizing the flow of heat in the vicinity of the support member 41).

If the requirements in terms of homogeneous heat treatment are imperatives, such a temperature gradient is not acceptable.

Moreover, a homogeneous temperature of the wafers during a heat treatment step is required when depositing or forming thin layers of materials having a highly uniform thickness.

BRIEF SUMMARY

The present invention aims to remedy the aforementioned disadvantage and concerns a support device for a plurality of wafers, the support device being adapted to be loaded into a heat treatment oven, the support device having a central axis, the support device including:

three uprights extending substantially parallel to the central axis, a plurality of series of support members spaced along the central axis, each series of support members comprising three support members adapted to support one wafer of the plurality of wafers and extending in different essentially longitudinal directions transverse to the central axis, each support member being mounted directly on a separate upright, the support device being remarkable in that the directions of the three support members of each series of support members are concurrent at a point on the central axis.

By central axis is meant the vertical axis of the support device when it is being used in a vertical heat treatment oven. A wafer intended to be supported by a series of support members has the central axis passing through its center when the wafer is positioned on the series of support members.

Accordingly, when the support device supports a plurality of wafers and is being used in a vertical oven, the directions concurrent at a point on the central axis of the three support members of each series of support members enable the radial radiant flux to propagate uniformly without blocking any of the flux.

In one embodiment, the support members of each series of support members are adapted to essentially form a point contact with the corresponding wafer.

Accordingly, holding the wafers so that there is essentially a point contact with the wafer making it possible to minimize the area of contact between the wafers and the support members.

Moreover, minimizing the area of contact between the wafers and the support members makes it possible to improve the radiant flux during a step of heat treatment of the wafers supported by the support device when it is being used in a vertical oven.

In one embodiment, the support members are distributed substantially uniformly along the central axis.

Accordingly, such a distribution enables much better equilibrium of the wafers.

The present invention also relates to a support device for a plurality of wafers, the support device being adapted to be loaded into a heat treatment oven, the support device having a central axis, the support device including:

three uprights extending substantially parallel to the central axis, a plurality of series of support members spaced along the central axis, each series of support members comprising three support members delimiting a central area, the three support members of the series of support members being adapted to support one wafer of the plurality of wafers in the central area, the central areas of all the series of support members defining a cylinder, the axis of which is the central axis, the three support members of each series extending in different essentially longitudinal directions transverse to the central axis, each support member being connected to a separate upright, each series of support members includes at least two connecting arms, each connecting arm being adapted to connect a support member to an upright, each connecting arm being contained within a peripheral area of the cylinder, the support device being remarkable in that the directions of the three support members of each series of support members are concurrent at a point on the central axis.

By peripheral area is meant the area adjacent the central cylinder and extending radially relative to the central cylinder.

Accordingly, when the support device supports a plurality of wafers and is being used in a vertical oven, the directions of the three support members of each series of support members concurrent at a point on the central axis enable the radial radiant flux to propagate uniformly.

The presence of the connecting arms makes it possible to decorrelate the distribution of the connecting members and the uprights. Thus, the function of a connecting arm is to offset the support member relative to the upright to which it is connected. This advantageously minimizes the overall size of the support device and thus enables use of the support device in a vertical oven of smaller volume.

The disposition of the connecting arms in the peripheral area makes it possible to avoid any disturbance or blocking of any of the radiant flux when the device is being used. The temperature distribution of the wafer during a heat treatment step in a vertical oven is therefore uniform.

In one embodiment, the support device comprises a cylinder portion and a peripheral area portion, the cylinder portion being the volume of the cylinder contained between two successive central areas along the central axis and the peripheral area portion extending radially relative to the cylinder portion, the connecting arms being disposed in the peripheral area portion.

By peripheral area portion is meant the area adjacent the cylinder portion and extending radially relative to the cylinder portion.

Accordingly, this disposition of the connecting arms advantageously prevents them from constituting an obstacle to the propagation of the radiant flux toward the wafers.

In one embodiment, the support members of each series of support members are adapted to essentially form a point contact with the corresponding wafer.

Accordingly, holding the wafers so that there is essentially a point contact with the wafer making it possible to minimize the area of contact between the wafers and the support members.

Moreover, minimizing the area of contact between the wafers and the support members makes it possible to improve the radiant flux during a step of heat treatment of the wafers supported by the support device when it is being used in a vertical oven.

In one embodiment, the uprights are disposed, in cross section, in an angular space around the central axis less than 180°.

In one embodiment, the support members of each series of support members are transversely distributed substantially uniformly along the central axis.

Accordingly, the uniform distribution of the support members around the central axis of the support members advantageously achieves complete radial symmetry of each series of support members.

Moreover, such a distribution enables much better equilibrium of the wafers.

The invention is advantageously completed by the following features separately or in any technically feasible combination:

the connecting arms are straight, the connecting arms are curved.

The two embodiments presented above are linked to form a single inventive general concept consisting in the directions of the three support members of each series being concurrent at a point on the central axis.

BRIEF DESCRIPTION OF THE DRAWINGS

Other features, aims and advantages of the invention will emerge from the following description, which is purely illustrative and is not limiting in the invention, and which should be read in conjunction with the accompanying drawings in which, in addition to FIGS. 1A, 1B and 2 already discussed.

DETAILED DESCRIPTION

For the various embodiments, to simplify the description, the same references are used for elements that are identical or have the same function.

Figure 1A:
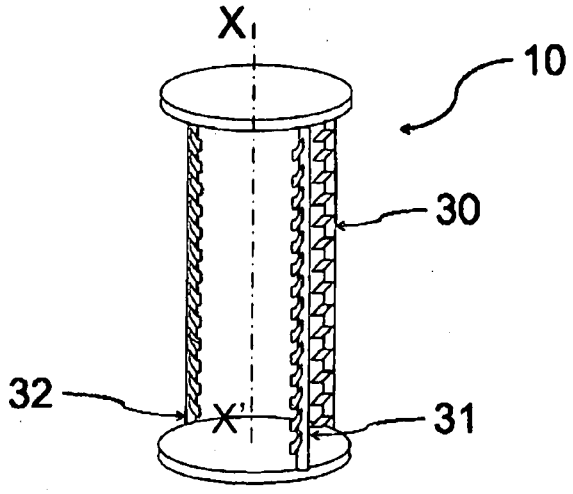
Fig 1A Prior Art
Figure 1B:
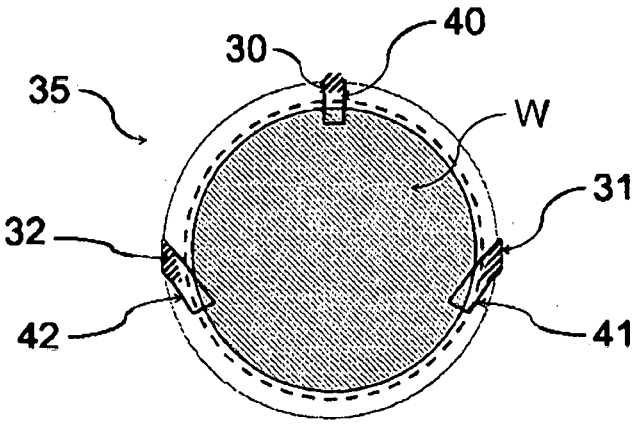
Fig 1B Prior Art
Figure 2:
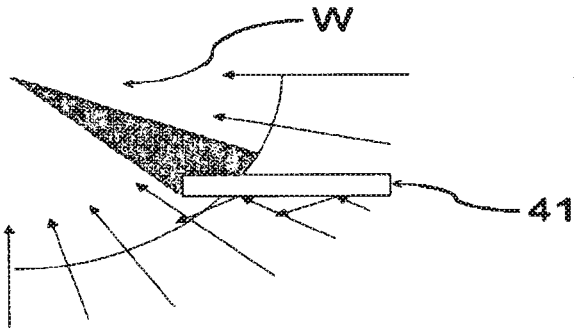
Fig. 2 Prior Art
Figure 3A:
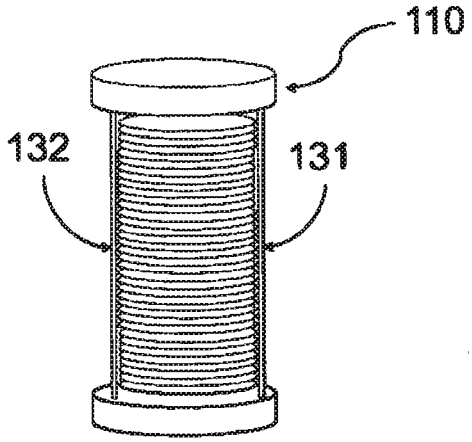
FIGS. 3A to 3C are diagrams showing a support device in accordance with the invention.
Figure 3B:
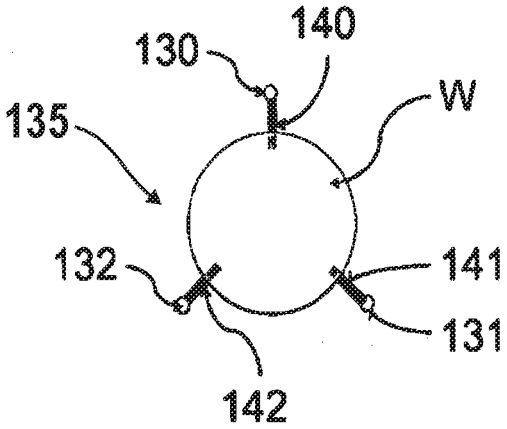
Figure 3C:
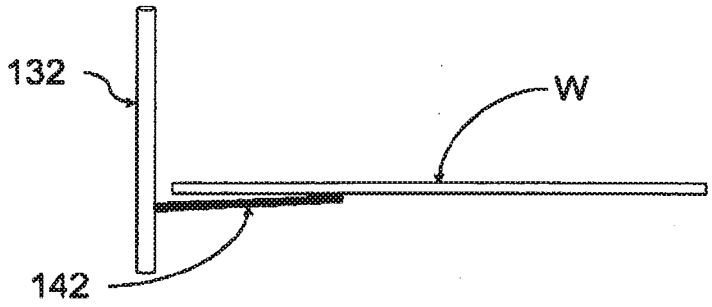

A support device 110 shown in FIGS. 3A to 3C is a device for supporting a plurality of wafers, the support device 110 being adapted to be loaded into a heat treatment oven, the support device 110 having a central axis, the support device 110 including:

three uprights 130, 131 and 132 extending substantially parallel to the central axis, a plurality of series of support members 135 spaced along the central axis, each series of support members 135 comprising three support members 140, 141 and 142 adapted to support one wafer W of the plurality of wafers and extending in different essentially longitudinal directions transverse to the central axis, each support member 140, 141 and 142 being mounted directly on a separate upright 130, 131, 132 and the directions of the three support members 140, 141 and 142 of each series of support members 135 are concurrent at a point on the central axis.

The uprights 130, 131 and 132 are advantageously the same length and are parallel to the central axis of the support device 110.

The uprights 131 and 132 have a lateral spacing at least equal to the diameter of the wafers that the support device 110 is adapted to support. This is to allow wafers W to pass between the uprights 131 and 132 in a horizontal position.

In a particularly advantageous manner, the uprights 130, 131 and 132 are equidistant from the central axis.

The series of support members 135 are spaced along the central axis. Each series of support members 135 is adapted to support one wafer W in a horizontal position when the support device 110 is being used.

Each series of support members 135 comprises three support members 140, 141 and 142. The support members 140, 141 and 142 of each series of support members 135 are mounted directly on the uprights 130, 131 and 132, respectively.

The support members 140, 141 and 142 of a series of support members 135 are disposed so as to support one wafer W essentially horizontally in a stable equilibrium position.

The support members 140, 141, 142 extend in different directions, the directions being concurrent at a point on the central axis.

In a particularly advantageous manner, as shown in FIG. 3C, the support members 140, 141 and 142 of each series of support members 135 are adapted to essentially make a point contact with the corresponding wafer W. The angle between a support member and a perpendicular to the upright on which it is mounted is preferably less than 5°.

The support members 140, 141 and 142 are advantageously distributed substantially uniformly along the central axis.

The present invention also relates to another support device.

Figure 4A:
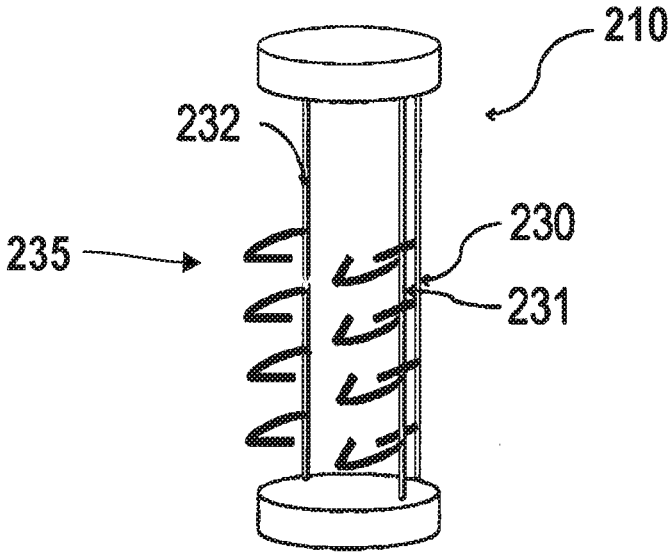
FIGS. 4A to 4C are diagrams showing the support device in accordance with the invention.
Figure 4B:
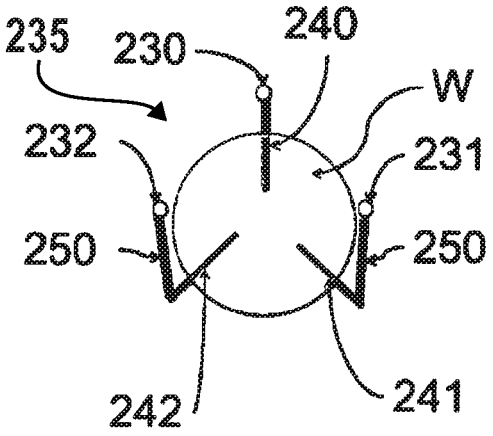
Figure 4C:
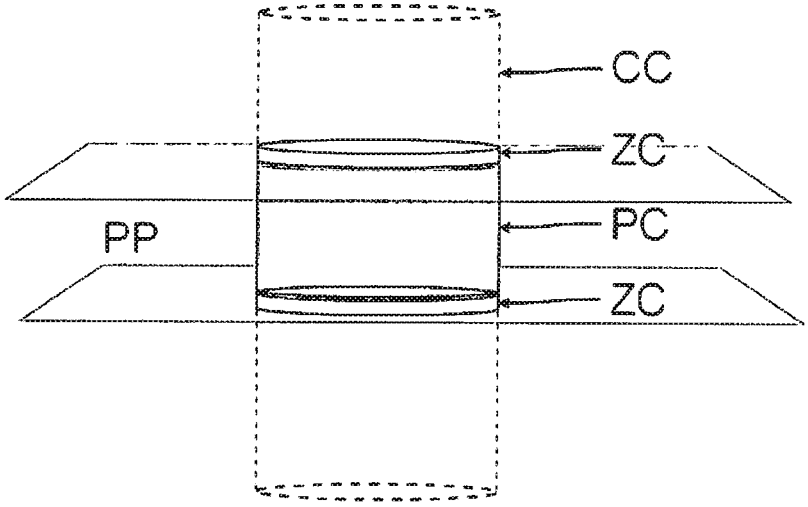

A support device 210 shown in FIGS. 4A-4C is a support device for a plurality of wafers, the support device 210 being adapted to be loaded into a heat treatment oven, the support device 210 having a central axis, the support device 210 including:

three uprights 230, 231 and 232 extending substantially parallel to the central axis, a plurality of series of support members 235 spaced along the central axis, each series of support members 235 comprising three support members 240, 241 and 242 delimiting a central area ZC, the three support members 240, 241 and 242 of the series of support members 235 being adapted to support one wafer W from the plurality of wafers in the central area ZC, the central areas ZC of all the series of support members 235 defining a cylinder CC the axis of which is the central axis, the three support members 240, 241 and 242 of each series of support members 235 extending in different essentially longitudinal directions transverse to the central axis, each of the support members 240, 241 and 242 being connected to a separate upright, each series of support members 235 includes at least two connecting arms 250, each connecting arm 250 being adapted to connect a support member to an upright, each connecting arm 250 being contained within a peripheral area of the cylinder CC, and the directions of the three support members 240, 241 and 242 of each series of support members are concurrent at a point on the central axis.

The uprights 230, 231 and 232 are advantageously the same length and are parallel to the central axis of the support device 210.

In a particularly advantageous manner, the uprights 230, 231 and 232 are equidistant from the central axis.

The series of support members 235 are spaced along the central axis. Each series of support members 235 is adapted to support one wafer W in a horizontal position when the support device 210 is being used.

Each series of support members 235 comprises three support members 240, 241 and 242.

The support members 240, 241 and 242 of a series of support members 235 are disposed so as to support one wafer W substantially horizontally in a stable equilibrium position in a central area ZC corresponding to the area occupied by a wafer W. The central area ZC defines a cylinder CC centered on the central axis. At least two of the support members 240, 241 and 242 of each series of support members 235 are connected to the uprights 230, 231 and 232, respectively, of the different connecting arms 250. The connecting arms 250 are disposed in a peripheral area ZP of the central cylinder CC.

The support members 240, 241 and 242 extend in different directions, the directions being concurrent at a point on the central axis.

In a particularly advantageous manner, the support device 210 comprises a cylinder portion PC and a peripheral area portion PP, the cylinder portion PC being the volume of the cylinder CC contained between two successive central areas ZC along the central axis and the peripheral area portion PP extending radially relative to the cylinder portion PC, the connecting arms 250 being disposed in the peripheral area portion PP.

The support members 240, 241 and 242 of each series of support members 235 are advantageously adapted to essentially form a point contact with the corresponding wafer.

The uprights 230, 231 and 232 are advantageously disposed, in cross section, in an angular space around the central axis less than 180°.

The support members 240, 241 and 242 of each series of support members 235 are advantageously transversely distributed substantially uniformly along the central axis.

The connecting arms are advantageously straight or curved.

The execution of a step of heat treatment of wafers disposed in a support device in accordance with the invention, the device being inserted into a vertical oven, enables greater uniformity of the wafers to be obtained. This result is valid for a support device whether it is equipped with connecting arms or not.

Thus, the invention makes it possible to limit blocking of any of the radiant flux by the support members, thus enabling the uniformity of the heat treatment of the wafers to be improved.

The invention claimed is:

1. A support device for a plurality of wafers, the support device being adapted to be loaded into a heat treatment oven, the support device having a central axis, the support device including:

three uprights extending substantially parallel to the central axis, and a plurality of series of support members spaced along the central axis, each series of support members comprising three support members delimiting a central area, the three support members of each series of support members being adapted to support one wafer of the plurality of wafers in the central area, the central areas of all the series of support members defining a cylinder, the axis of which is the central axis, the three support members of each series of support members extending in different essentially longitudinal directions transverse to the central axis, each support member within each series of support members being connected to a separate upright, each series of support members including at least two connecting arms between at least two respective support members and at least two respective uprights, each connecting arm extending in a first direction from the respective upright that is different from and at an angle to a second direction in which the support member to which the connecting arm is connected extends, each connecting arm being contained within a peripheral area of the cylinder, the directions of the three support members of each series of support members being concurrent at a point on the central axis.

2. The support device of claim 1, comprising a cylinder portion and a peripheral area portion, the cylinder portion being the volume of the cylinder contained between two successive central areas along the central axis and the peripheral area portion extending radially relative to the cylinder portion, the connecting arms being disposed in the peripheral area portion.

3. The support device of claim 2, wherein the support members of each series of support members are adapted to essentially form a point contact with the corresponding wafer.

4. The support device of claim 2, wherein the uprights are disposed, in cross section, in an angular space around the central axis less than 180°.

5. The support device of claim 1, wherein the support members of each series of support members are adapted to essentially form a point contact with the corresponding wafer.

6. The support device of claim 5, wherein the uprights are disposed, in cross section, in an angular space around the central axis less than 180°.

7. The support device of claim 5, wherein the support members of each series of support members are transversely distributed substantially uniformly along the central axis.

8. The support device of claim 5, wherein the connecting arms are straight.

9. The support device of claim 5, wherein the connecting arms are curved.

10. The support device of claim 1, wherein the uprights are disposed, in cross section, in an angular space around the central axis less than 180°.

11. The support device of claim 10, wherein the support members of each series of support members are transversely distributed substantially uniformly along the central axis.

12. The support device of claim 10, wherein the connecting arms are straight.

13. The support device of claim 10, wherein the connecting arms are curved.

14. The support device of claim 1, wherein the support members of each series of support members are transversely distributed substantially uniformly along the central axis.

15. The support device of claim 1, wherein the connecting arms are straight.

16. The support device of claim 1, wherein the connecting arms are curved.

* * * * *